United States Patent [19]

Kilpatrick

[11] Patent Number: 4,726,090

[45] Date of Patent: Feb. 23, 1988

[54] GUTTER CLEANING DEVICE

[76] Inventor: Norman K. Kilpatrick, 2818 Keystone Dr., Cincinnati, Ohio 45230

[21] Appl. No.: 824,599

[22] Filed: Jan. 31, 1986

[51] Int. Cl.[4] ..... A47L 13/00

[52] U.S. Cl. ..... 15/236 R; 15/144 R

[58] Field of Search ..... 15/236 R, 144 R

[56] References Cited

U.S. PATENT DOCUMENTS

| | | | |
|---|---|---|---|
| 2,817,867 | 12/1957 | Bugbird | 15/172 |
| 3,626,542 | 12/1971 | Despain | 15/236 |
| 3,858,267 | 1/1975 | Swannie | 15/236 R |
| 4,194,780 | 3/1980 | Dilley | 294/19 R |
| 4,502,806 | 3/1985 | Albertson | 401/137 |
| 4,542,553 | 9/1985 | Cary | 15/236 R |

OTHER PUBLICATIONS

Popular Science Monthly, Sep. 1938, p. 68.

*Primary Examiner*—Chris K. Moore

*Attorney, Agent, or Firm*—Jeffrey V. Bamber

[57] ABSTRACT

A device for cleaning leaves and other debris from elevated roof gutters for use by a person standing on the roof of a house or building which includes a rake member for scraping leaves and other debris from the bottom of a gutter and a handle for manipulating the rake member. In its preferred form, the rake member is substantially flat, generally rectangular, and slotted, and has a bottom edge bent out of the plane of the rake member, and a side edge also bent out of the plane of the flat portion of the rake member into a plurality of fingers arranged in a step-like manner for lifting and grasping leaves and other debris during removal from the gutter.

4 Claims, 4 Drawing Figures

GUTTER CLEANING DEVICE

BACKGROUND OF THE INVENTION

1. Field of the Invention

The present invention relates generally to cleaning implements, and more particularly, is concerned with a device for cleaning leaves and other debris from elevated roof gutters which can be used by a person standing on the roof of a house or building.

2. Description of the Prior Art

Frequently leaves, twigs and other debris will collect in the roof gutters of homes and buildings, and unless periodically removed, will accumulate to the point of obstructing the flow of rain water in the gutters and clogging the downspouts to which the gutters lead. In addition to rendering the gutters and downspouts ineffective for channeling water from the roof, the accumulation of debris within the gutters can create more serious problems for the homeowner or building owner, including that of substantial damage to the roof and gutters which will result from the weight of standing water remaining in the gutters.

Presently, in an attempt to avoid these problems, most homeowners and those responsible for the maintenance of buildings either climb a ladder up to the gutter, or climb onto the roof, to remove debris from the gutter by hand. The first method is unsatisfactory in that the person cleaning the gutter may only reach a portion of the gutter when at the top of the ladder, and as a result, must make a great many trips up and down the ladder, moving the ladder each time to a new location to clean the remaining portions of the gutter. Alternatively, those who choose to clean the gutters from the roof must position themselves at or near the edge of the roof in order to reach into the gutter to remove the debris by hand. As is most often the case, there is nothing for these persons to hold onto should they accidentally venture too far toward the edge or slip near the edge of the roof. Both methods of cleaning roof gutters by hand are time-consuming, labor-intensive, and can be potentially dangerous.

Because of these problems, prior attempts have been made to design instruments which would make the task cleaning elevated roof gutters less difficult and dangerous. Most of the prior instruments are intended to be operated by persons standing on the ground below the gutters. The prior devices are generally comprised of long poles attached to a cleaning tool of some type which is designed to be engaged in a gutter and push debris along inside the gutter. To remove debris from the gutter, the operator must turn and manipulate the handle of the pole to scoop or sweep the debris out with the cleaning tool. This is generally only done after the debris is pushed to the end of the gutter. Examples of this type of device are seen in Despain U.S. Pat. No. 3,626,542, Swannie U.S. Pat. No. 3,858,267, and Albertson U.S. Pat. No., 4,502,806.

One serious drawback with these devices is that they provide no adequate means for cleaning under and around the support spikes or braces which hold the gutter to the house or building. Although a few of these devices provide a cleaning tool designed to clean under these spikes, the operator standing on the ground below the gutter must perform the difficult and cumbersome operation of manipulating the tool in the gutter underneath each support spike, then must remove the tool portion from the gutter on one side of the spike and reinsert it in the gutter on the opposite side. The higher the gutter is from the ground, the longer and heavier the pole must be made to reach the gutter, the more difficult this procedure becomes. In addition, inherent in all devices intended for use by persons standing on the ground below the gutters is the problem that the tool portion will only move through a relatively small angle when the operator rotates the pole. This has the drawback that few of these devices can be manipulated to actually remove more than minor amounts of debris from the gutters. Other drawbacks include: the inability of the operator to see inside the gutter while cleaning; a need to pull down on the device to remove matted down leaves and debris, which is an inefficient means for applying the force needed to dislodge the debris, and which risks pulling down the entire gutter; generally no means to periodically dump debris out of the gutter; and, the likelihood that debris will be dumped upon the operator standing on the ground below.

Consequently, a need exists for an improved form of gutter cleaning device which is simple to manufacture and use, and which adequately overcomes the deficiencies of the prior attempts to satisfy this need.

SUMMARY OF THE INVENTION

With the above background in mind, it is an object of the present invention to provide a device for cleaning elevated roof gutters which overcomes the above-mentioned drawbacks of known prior-art cleaning implements.

Specifically, it is a primary object of the present invention to provide an implement for removing leaves and other debris from roof gutters designed for use by a person standing on the roof of a house or building that provides an effective means for cleaning under and around gutter support spikes and for completely removing debris from the gutters.

It is a further object of this invention to provide a gutter cleaning device which permits the operator to see inside the gutter while cleaning, and thereby insures that the operator will be less likely to run into the gutter support spikes while using the device.

It is a further object of this invention to provide a gutter cleaning device which is constructed so that the force required to remove leaves and other debris matted down inside the gutter can be applied in a direct and efficient manner to reduce the possibility of damage to the gutters.

Another object of the present invention is to provide a gutter cleaning device which permits the operator to periodically dump leaves and debris out of the gutter while insuring that the debris is not dumped upon the operator.

It is a further object of this invention to provide an implement for removing leaves and other debris from roof gutters that is lightweight, durable, economical to manufacture, and which is easy to use, requires a minimum of skill, and little or no experience to operate.

These as well as other objects which will become apparent as the description proceeds, are fulfilled by the provision of the inventive gutter cleaning device characterized by a rake member for scraping leaves and debris from the bottom of the gutter, the width of which is less than the inside width of a typical gutter, and a handle connected to the rake member for manipulating the rake member in the gutter by a person standing on the roof of a house or building while maintaining a distance away from the edge of the roof. In its preferred form, the rake member has a bottom edge and an adjacent first side edge, which is on the side opposite the house when the device is inserted into a gutter, both of which are bent out of the plane of the rake member at an angle so that the operator may lift debris out of the gutter and dispose of the debris over the side of the gutter.

BRIEF DESCRIPTION OF THE DRAWINGS

The invention itself will be better understood, and additional advantages and features of the invention will become apparent from the following detailed description of the preferred embodiments of the invention, taken in conjunction with the accompanying drawings, in which.

DETAILED DESCRIPTION OF THE INVENTION

Figure 1:
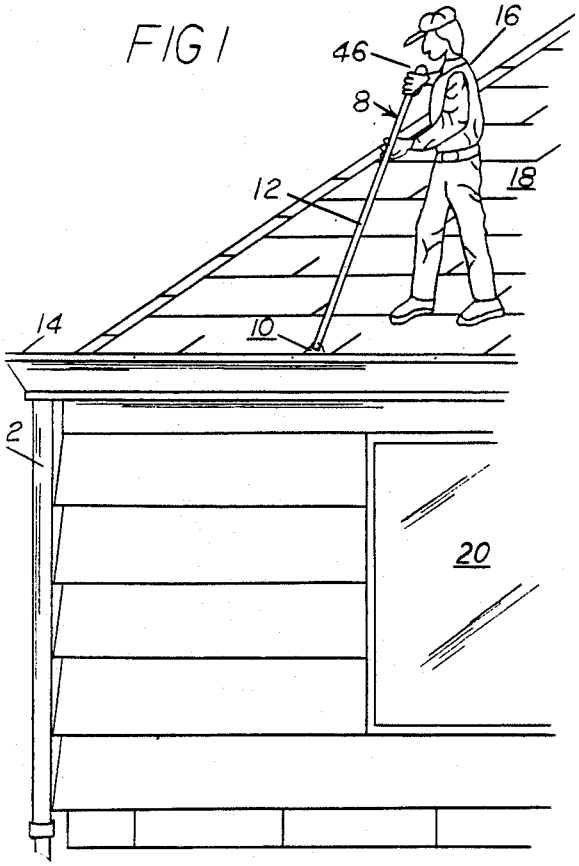
FIG. 1 is an elevational view of a portion of a house provided with a conventional roof gutter illustrating a person standing on the roof of the house using the gutter cleaning device of the present invention to clean the roof gutters.

Referring now to the drawings and more particularly, to FIG. 1, there is shown a gutter cleaning device, generally designed 8, which comprises the preferred embodiment of the present invention. The device 8 includes a rake member 10 connected to a handle 12, for manipulating the rake member 10 in a gutter 14 by a person 16 standing on the roof 18 of the house or other building 20. The gutter cleaning device of the present invention is shown in place in a gutter 14, which runs parallel to the roof 18 of a house or building 20, and empties into a downspout 22 on the side of the building 20. When the device 8 is inserted into the gutter 14 such that the plane of the rake member 10 is approximately normal to the longitudinal axis of the gutter 14, and the handle 12 is adjusted to the appropriate angle, as seen in FIG. 2, the bottom edge 24 of the rake member 10 is maintained in contact with the bottom of the gutter 34 and the operator may stand on the roof 18 of the house or building 20 away from the edge thereof to manipulate the rake member 10 in the gutter 14 for removal of leaves and other debris therefrom.

Figure 2:
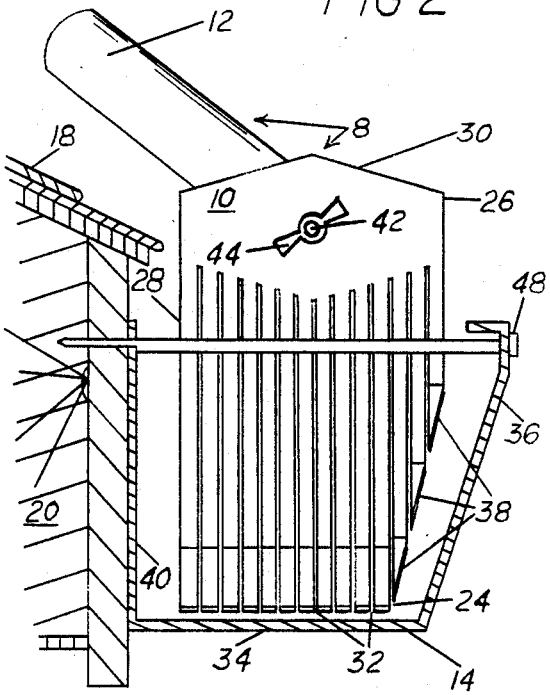
FIG. 2 is a side view of the rake member of the gutter cleaning device of the present invention shown in operative position on the far side of a gutter hanging spike inside a typical modern gutter, here illustrated in cross-section.
Figure 3:
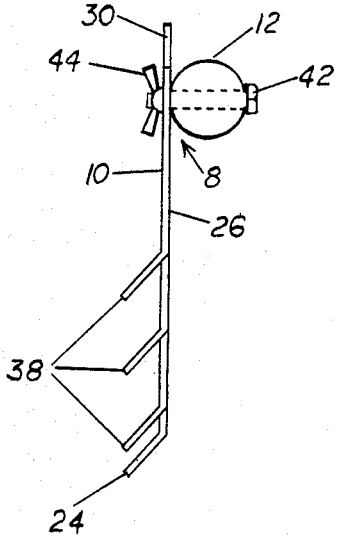
FIG. 3 is an end view of the rake member of the gutter cleaning device of the present invention.
Figure 4:
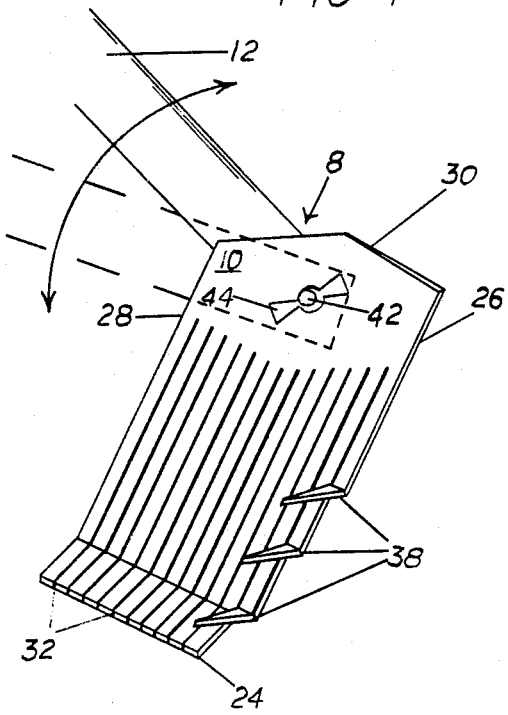
FIG. 4 is a perspective view of the rake member of the gutter cleaning device of the present invention.

As shown in FIG. 2, the rake member 10 of this embodiment of the invention is substantially rectangular in shape, and has a bottom edge 24, a first side edge 26, which faces opposite the house 20 when the device 8 is inserted into the gutter 14, a second side edge 28 opposite the first side edge 26, and a top edge 30 opposite the bottom edge 24. To permit insertion of the rake member 10 into the bottom of the gutter 34 for scraping leaves and other debris matted down on the bottom of the gutter 34, or lying free in the gutter 14, the bottom edge 24 is of a width which is less than the inside width of a typical gutter. As seen in FIGS. 3 and 4, the rake member 10 may be generally flat, with the bottom edge 24 bent out of the plane of the flat portion at an obtuse angle with the plane of the rake member 10. The preferred angle between the bottom edge 24 of the rake member 10 and the plane thereof has been found to be approximately 135 degrees. In addition, the bottom edge 24 may be slotted with a plurality of slots 32. which extend from the bottom edge 24 toward the top edge 30 up to or through the aforementioned bend, giving the rake member 10, and the bottom edge 24 thereof, the appearance of tines on a garden rake. When so slotted, the bottom edge 24 is provided with an efficient means for grasping the leaves and other debris in the gutter 14 and for lifting and disposing the leaves and debris over the side of the gutter 14, while permitting water remaining in the gutter 14 to pass through the rake member 10 during the cleaning operation.

In the preferred embodiment, the first side edge 26 is inclined inwardly toward the second side edge 28 from the top edge 30 to the bottom edge 24 to permit the rake member 10 to fit inside virtually all types of gutters including the gutter 14 shown in FIG. 2 with a straight outside edge 36 as well as inside gutters with curved outside edges. Also in this embodiment, the slotted portions of the rake member 10 along this inclined first side edge 26 are bent at gradually increasing distances from the bottom edge 24 thereof into a plurality of fingers 38 which are arranged in a step-like manner for grasping leaves and other debris in the gutter 14 during removal from the gutter 14. The angles between these fingers 38 and the plane of the rake member 10 are approximately equal to the angle between the bottom edge 24 of the rake member 10 and the plane of the rake member 10. As seen when viewing the device 8 as shown in FIG. 3, the bottom edge 24 and the fingers 38 on the first side edge 26 of the rake member 10 have been bent out of the plane of the rake member 10 in a clockwise direction. In another variation of the gutter cleaning device of the present invention 8, the bottom edge 24 and fingers 38 may be bent out of the plane of the rake member 10 in the opposite, or a counterclockwise direction, thereby providing both right-hand and left-hand versions of the present invention.

The top edge 30 of the rake member 10 is generally parallel to the bottom edge 24 thereof, and beveled inwardly toward the bottom edge 24 from the central vertical axis of the rake member 10 to both the first and second side edges 26 and 28 in order to permit the device 8 to be inserted into the gutter 14 while maintaining clearance of the rake member 10 from any roof shingle overhang as the blade is moved along the length of the gutter 14 during the cleaning procedure. Near the top edge 30, on the vertical axis of the rake member 10, a hole is drilled, at such a distance from the bottom edge 24 as will permit the handle 12 to clear the inside edge 40 of a typical gutter when the device 8 is placed in operative position with the rake member 10 inside the gutter 14 and the bottom edge 24 in contact with the bottom surface of the gutter 34.

The rake member 10 when in its preferred form, is fashioned from a flat piece of metal, wood, plastic, or other suitable material, which is first cut into the desired generally rectangular shape, the overall width of which, from first side edge 26 to second side edge 28 can vary in different embodiments from slightly less than the inside width of a typical gutter to less than half of the inside width of a typical gutter. Also in this preferred embodiment, the rake member 10 may be shaped substantially like the inside of a typical gutter to provide a means for uniformly cleaning the entire inside of the gutter. Once in the desired rectangular shape, the plate which is to form the rake member 10 is slotted with slots 32 at the bottom edge 24 thereof the desired distance toward the top edge 30. When these slots 32 are cut to the desired lengths, the fingers formed thereby are then bent at the desired angle relative to the plane of the rake member 10.

A handle 12 is attached to the rake member 10 by means of a bolt 42 and nut 44, or other suitable means of attachment. The handle 12, can be a solid rod or a hollow tube made from aluminum, fiberglass, wood, or other suitable material, and can be of any shape or diameter, but has been found easiest for an operator to manipulate when it is of a circular cross section with a diameter of approximately one inch (2.54 cm.). The length of the handle 12 can vary depending on the distance the operator desires to stand away from the edge of the gutter; however, a length of approximately five feet (1.52 m.) has been found to be effective. In its preferred embodiment, a bicycle handle bar grip 46 is attached to the end of the handle 12 intended to be held by the operator, to provide for greatest ease in manipulating the device 8, particularly the rake member 10 inside the gutter 14. At the opposite end of the handle 12, a single hole is drilled near the end of the handle 12 perpendicular to the longitudinal axis of the handle 12 so the axis of the handle 12 when attached to the rake member 10 will lie in substantially the same plane, or in a closely parallel plane to the body of the rake member 10. When the hole drilled in the rake member 10 is aligned with the hole drilled in the handle 12, a bolt 42 may be passed through both holes, and when a nut 44 is placed on the other end of the bolt 42 and tightened, the rake member 10 may be frictionally retained at any desired angle with the handle 12. In the preferred form, the fastening device is a wing nut 44, which may be adjusted by hand by an operator on the roof of a house without the aid of tools or the like, to any desired angle prior to employing the device 8 to clean a gutter 14. In addition, it is also within the scope of this invention that the rake member 10 and the handle 12 be constructed in a single piece and at a fixed angle.

In operation, the rake member 10 is inserted in the gutter 14, with the bottom edge 24 substantially normal to the longitudinal axis of the gutter 14, and with the bottom edge 24 in contact with the bottom surface 34 of the gutter 14. To clean the gutter 14, the operator 16 may hold the handle 12 and either walk along the roof 18 parallel to the longitudinal axis of the gutter 14 moving the rake member 10 at the same time and maintaining a slight downward pressure on the handle 12 to retain the bottom edge 24 of the rake member 10 in contact with the bottom surface 34 of the gutter 14, or the operator may stand in a relatively stationary position while moving the rake member 10 inside the portion of the gutter 14 within reach, and then may move to a different position on the roof 18 to clean another portion of the gutter 14. When the rake member 10 is moved along the bottom surface 34 of the gutter 14, leaves and other debris remaining in the gutter 14 are accumulated in front of the rake member 10 in the direction of movement. This process is continued until either a substantial volume of debris is accumulated in front of the rake member 10 or a transversely extending gutter spike 48 is encountered in the gutter 14. In the first situation, when the bottom edge 24 and fingers 38 on the first side edge 26 are bent out of the plane of the rake member 10 in the direction shown, the operator 16 merely rotates the handle 12 counterclockwise about its longitudinal axis which causes the debris to be grasped by the tines forming the bottom edge 24 of the rake member 10 and the plurality of fingers 38 on the first side edge 26 of the rake member 10, and the debris can be raised out of the bottom of the gutter 14. The entire gutter cleaning device 8 is then moved so that the rake member 10 is lifted out of the top of the gutter 14 and the debris is disposed of over the front or outside edge 36 of the gutter 14. Following the dumping of the debris over the front or outside edge 36 of the gutter 14, the device 8 is reinserted into the gutter 14, and the process is repeated.

When a transversely extending gutter hanging spike 48 is encountered, the handle 12 of the device 8 can be rotated counterclockwise when it is in close proximity to the gutter hanging spike 48, in such a manner that the leaves and other debris are in effect trapped or pinched between the rake member 10 and the gutter hanging spike 48. The operator 16 can thereby use the gutter hanging spike 48 to his or her benefit in lifting the debris out of the gutter 14. The bulk of the debris is then disposed over the side of the gutter 14. To completely clean under the gutter hanging spike 48, when the rake member 10 is reinserted into the gutter 14, the handle 12 is placed adjacent to the gutter hanging spike 48 as shown in FIG. 2. Once in this position, the bottom edge 24 of the rake member 10 may be turned slightly backward, and by then turning the handle 12 counterclockwise, the bottom edge 24 of the rake member 10 will turn until it is slightly forward of the handle 12, to move the debris under the spike 48. The device 8 is then lifted out of the gutter 14 and reinserted into the gutter 14 on the opposite side of the gutter hanging spike 48 with the bottom edge 24 of the rake member 10 again tilted slightly backward. The rake member 10 is then again turned counterclockwise to move the debris away from the gutter hanging spike 48. This procedure is continued until the end of the gutter is reached, at which point the remaining debris may be scooped out of the gutter 14 with the aid of the side wall at the end of the gutter 14 and thrown onto the ground.

It is to be understood that the form of the invention shown in the accompanying drawings and described in this specification is the preferred example of the same, and this invention is not limited to the exact arrangement of parts shown or described, and various changes in the details of construction as to size, shape, and arrangement of parts may be made without departing from the spirit of the invention, the scope of the novel concepts of the invention, or the scope of the following claims.

Having thus described the invention, what is claimed is:

1. A device for cleaning leaves and other debris from elevated roof gutters for use by a person standing on the roof of a house or building, comprising:

a rake member for scraping leaves and other debris from the bottom of a gutter which has a bottom edge which is bent out of the plane of the rake member, and an adjacent first side edge, wherein at least a portion of the first side edge is also bent out of the plane of the rake member but at a separate location from the bend along the bottom edge of the rake member; and, a handle connected to the rake member so the person may manipulate the rake member in the gutter while standing on the roof and maintaining a distance away from the edge of the roof.

2. A device for cleaning leaves and other debris from elevated roof gutters for use by a person standing on the roof of a house or building, comprising:

a rake member for scraping leaves and other debris from the bottom of a gutter, the width of which is less than the inside width of a typical gutter, having a top edge, a bottom edge opposite the top edge, a first side edge which is on the side opposite the house when the device is inserted into a gutter, and a second side edge opposite the first side edge, wherein the bottom edge and first side edge of the rake member are bent out of the plane of the rake member at an angle, and a plurality of slots extend from the bottom edge of the rake member toward the top edge of the rake member to permit water to pass through the rake member during use, and the first side edge is inclined inwardly toward the second side edge from the top edge to the bottom edge with the slotted portions of the rake member along the inclined first side edge bent at gradually increasing distances from the bottom edge of said rake member into a plurality of fingers which are arranged in a step-like manner to provide a means for grasping leaves and other debris in the gutter so that the operator may lift debris out of the gutter and dispose of the debris over the side of the gutter; and, a handle connected to the rake member so the person may manipulate the rake member in the gutter while standing on the roof and maintaining a distance away from the edge of the roof.

3. The device of claim 2 wherein the rake member is adjustably connected to the handle so the angle between the rake member and the handle may be varied for different users and roof pitches.

4. The device of claim 2 further comprising a bicycle handlebar grip which is connected to the end of the handle opposite the rake member for ease of manipulating the device in the gutter and in removing leaves and other debris from the gutter.

* * * * *